United States Patent [19]

Eguchi et al.

[11] Patent Number: 4,936,742

[45] Date of Patent: Jun. 26, 1990

[54] WATER PUMP APPARATUS HAVING LUBRICATING OIL CIRCULATION AND AXIAL THRUST SUPPORT

[75] Inventors: Katsuhiko Eguchi, Kariya; Atsushi Ohmi, Anjo, both of Japan

[73] Assignee: Aisin Seiki Kabushiki Kaisha, Kariya, Japan

[21] Appl. No.: 301,717

[22] Filed: Jan. 26, 1989

[30] Foreign Application Priority Data

Jan. 29, 1988 [JP] Japan ..... 63-12006[U]

[51] Int. Cl.[5] ..... F01D 25/18

[52] U.S. Cl. ..... 415/111; 415/107; 415/112; 384/397

[58] Field of Search ..... 415/110, 111, 104, 107, 415/229, 230, 112; 384/275, 397, 398, 399, 414

[56] References Cited

U.S. PATENT DOCUMENTS

| | | | |
|---|---|---|---|
| 1,144,115 | 6/1915 | Fjellman | 384/275 |
| 2,833,601 | 5/1958 | Guinard | 415/110 |
| 3,170,646 | 2/1965 | Springer | 415/110 |
| 3,350,018 | 10/1967 | Harris et al. | 384/399 |
| 3,622,212 | 11/1971 | Laumont | 384/398 |
| 3,804,474 | 4/1974 | Ettles | 384/399 |

FOREIGN PATENT DOCUMENTS

| | | | |
|---|---|---|---|
| 581701 | 8/1959 | Canada | 384/397 |
| 10997 | 1/1986 | Japan . | |
| 575979 | 3/1946 | United Kingdom | 384/275 |
| 1577737 | 10/1980 | United Kingdom | 384/398 |

*Primary Examiner*—Robert E. Garrett
*Assistant Examiner*—John T. Kwon
*Attorney, Agent, or Firm*—Oblon, Spivak, McClelland, Maier & Neustadt

[57] ABSTRACT

A water pump apparatus has an impeller mounted on a driven rotational shaft rotatably supported by mutually spaced bearing portions in a body member. In order to lubricate the sliding bearing surfaces between the bearing portions and the rotational shaft, oil seals surrounding the rotational shaft define first and second oil tanks, while a third oil tank is defined between the bearing portions. Spiral oil circulating grooves pump oil from the first and second tanks along the sliding bearing surface to the third tank in order to lubricate the sliding bearing surfaces. Oil passages in the bearing portions permit oil to be returned to the first and second tanks. An annular flange fitted on the rotational shaft fits between the bearing portions to provide axial bearing support for the rotational shaft. Excess oil pressure arising due to heat build up is relieved by a check valve mounted in the body member.

8 Claims, 1 Drawing Sheet

WATER PUMP APPARATUS HAVING LUBRICATING OIL CIRCULATION AND AXIAL THRUST SUPPORT

BACKGROUND OF THE INVENTION

1. Field of the Invention

This invention relates to a water pump apparatus, and more particularly to a water pump apparatus which is used in an internal combustion engine of a water cooled type and includes lubrication of a sliding bearing surfaces for the pump rotational shaft.

2. Description of the Related Art

A conventional apparatus of this type is, for example, disclosed in Japanese Utility Model Laid Open No. 61-10997.

As shown in FIGS. 5 and 6, in which the conventional water pump apparatus is described, an impeller 4 is fixedly connected to one end of a drive shaft 35 supported on a body member 31 and the drive shaft 35 is rotated by an external power means via a gear 34. The drive shaft 35 is directly supported in an inner hole 32 provided in the body member 31. In order to lubricate the sliding surface between drive shaft 35 and the inner hole 32, concave portions 33, 33 are provided at upper and lower portions of the body member 31 to retain lubricating oil, and oil seals 36, 36 are positioned at the ends of the concave portions 33, 33 in order to seal the oil in the concave portions. These concave portions 33, 33 communicate with each other via a sliding surface between the inner hole 32 and the drive shaft 35, and another communicating passage is not positively provided.

The oil sealed in the concave portions 33 is thus circulated only via the sliding bearing surfaces between the inner hole 32 and the drive shaft 35, so that the circulation of the oil is not smoothly performed. As a result, the surface of the drive shaft is subjected to oxidative deterioration and the drive shaft 35 is sometimes seized Further, the oil sealed in the concave portion 33 is not perfectly sealed by oil seals 36, 36, so that oil leakage past the oil seals 36, 36 may occur due to the pressure increase generated by thermal expansion during rotation of the drive shaft 35.

The thrust force created by the rotation of the impeller 4 is supported only by the gear 34, so that the water pump apparatus is restricted only to such gear drive, unless a mechanism for maintaining the thrust force is provided at an outer portion of the water pump. As a result, the applicable field of this type of water pump apparatus is restricted.

SUMMARY OF THE INVENTION

It is therefore an object of the present invention to provide a water pump apparatus which obviates the above-mentioned drawbacks.

It is another object of the present invention to provide a water pump apparatus in which a drive shaft is prevented from seizing, by providing smooth delivery of the oil to sliding bearing surfaces.

It is a further object of the present invention to provide a water pump apparatus in which oil leakage generated by thermal expansion is prevented.

It is still a further object of the present invention to provide a water pump apparatus in which a mechanism for supporting a thrust force is provided.

According to the present invention, the above, and other, objects are achieved by a water pump apparatus in which a driven rotational shaft carries an impeller and is rotatably supported by mutually spaced bearing portions in a body member In order to lubricate the sliding bearing surfaces between the rotational shaft and the bearing portions, oil seals surround the rotational shaft and are spaced from the bearing portions so as to define in the bearing member a first oil tank between one of the seals and one of the body portions, a second oil tank between a second of the seals and a second of the bearing portions and a third oil tank between the spaced bearing portions. Oil passages communicate between the third oil tank and each of the first and second oil tanks while oil circulating grooves extend between the third oil tank and each of the first and second oil tanks. Each of the oil circulating grooves communicates with one of the sliding bearing surfaces between the rotational shaft and a respective one of the bearing portions, and each of the oil circulating grooves is oriented so as to pump oil therethrough, and between the third oil tank and a respective one of the first and second oil tanks, in response to the rotation of the rotational shaft. Oil is therefore smoothly delivered to the sliding bearing surfaces through the circulating grooves, and is circulated between the third tank and the first and second tanks.

In order to prevent oil leakage generated by thermal expansion, the present invention includes means for relieving pressure from the third tank to the exterior of the body member.

In order to provide a mechanism for supporting a thrust force, an annular flange is fitted on the rotational shaft between the bearing portions to help define the third oil tank while bearing against one of the bearing portions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
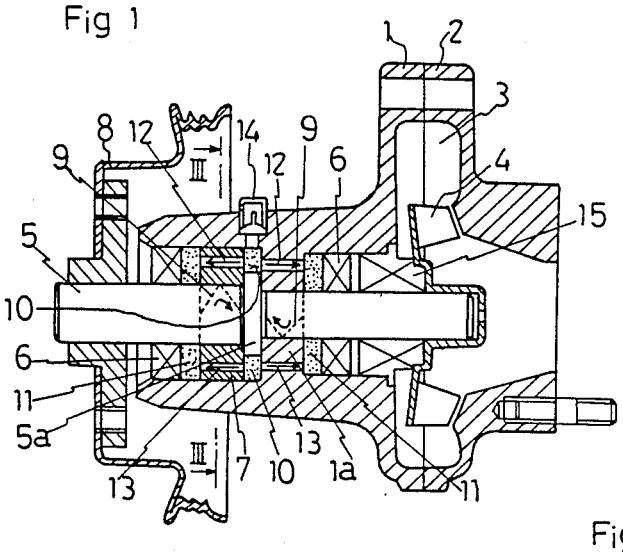
FIG. 1 is a sectional view of a preferred embodiment of a water pump apparatus according to the present invention.
Figure 2:
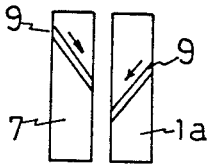
FIG. 2 is a developed view of sliding bearing surfaces according to the present invention.
Figure 3:
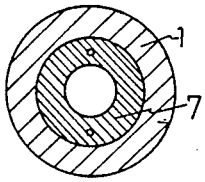
FIG. 3 is a view taken along line III—III of FIG. 1.

In FIGS. 1 to 4, a reference numeral 1 denotes a body member and a cover 2 is fixed thereto. An impeller 4 is located in a space 3 formed by the body member 1 and the cover 2 and is fixedly connected to one end of the rotational shaft 5. The rotational shaft 5 is provided with an annular flange portion 5*a* extending perpendicularly to a rotational center of the shaft 5 and at a center portion thereof to form thrust bearing surfaces. The rotational shaft 5 is rotatably supported by a bearing portion 7 fixedly inserted in an inner hole of the body member 1 and a bearing portion 1*a* integrally formed with body member 1 between oil seals 6, 6 which are provided at a gap formed by the body member. A pulley 8 is fixed to the other end of the rotational shaft 5 which is rotatably driven by an external power means via the pulley 8.

In order to provide means for lubricating the sliding bearing surfaces between the rotational shaft 5 and the bearing portions 7, 1*a*, an oil circulating groove 9 is formed on the inner circumferential surface of each of the bearing portions 7, 1. The grooves 9 are angled with respect to the rotational axis i.e., are spiral, so that they act to pump oil along the sliding bearing surface in the arrow directions during rotation of the rotational shaft 5. The axial thrust force is supported between bearing portions 7, 1*a* by the thrust bearing surfaces defined by the flange portion 5*a* integrally formed on the rotational shaft 5 bearing against one of the bearing portions. An intermediate (third) oil tank 10 is formed in the body member between the bearing portions 7, 1*a* and receives oil pumped by the left and right (first and second) oil tanks 11, 11 which are surrounded by the oil seals 6, 6, rotational shaft 5, and the inner circumferential surface of the body member 1 are formed at opposite sides of bearing portions 7, 1*a*.

Passages 12, 12, 13, and 13 are formed at upper and lower portions of bearing portions 7, 1*a* and are substantially parallel to the rotational axis of the shaft 5 for communicating oil tanks 10, 11 and also for acting as a passage for air-breathing upon oil entering into the oil circulating grooves 9. A reference numeral 14 is a check valve communicated with the oil tank 10 and fixed to an upper portion of the body member 1 for preventing a pressure increase for being generated by a temperature change within oil tanks 10, 11 and 11. A reference numeral 15 is a seal member for preventing the invasion of water into the bearing portion 1*a* from the space 3 (water chamber portion).

When the rotational shaft 5 is rotated by the external power means via the pulley 8, the oil within left and right oil tanks 11, 11 is pumped into the intermediate oil tank 10 by the oil circulating grooves 9 as shown by the arrows and returns to the oil tanks 11 via passages 12, 12, 13, and 13, as shown by the arrows, thereby forming a continuous oil circulation flow path for lubricating the sliding bearing surfaces between the rotational shaft 5 and the bearing portions. Additionally, since the oil must pass between the flange portion 5*a* and the bearing portions 7, it lubricates the thrust bearing surfaces providing thrust force support for the shaft.

Figure 4:
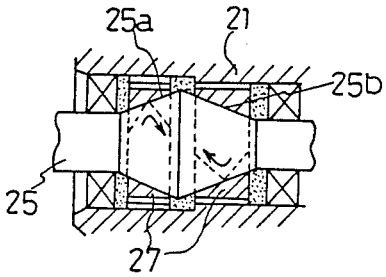
FIG. 4 is a view showing an essential portion of an alternative mechanism for maintaining a thrust force.
Figure 5:
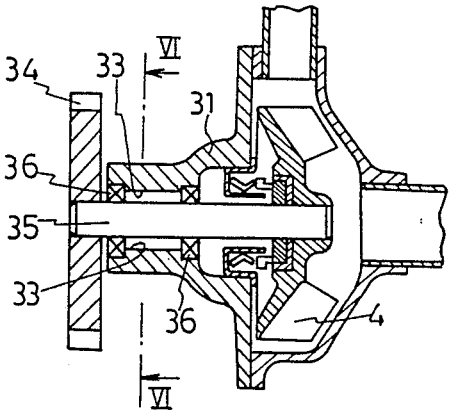
Fig 5 PRIOR ART
FIG. 5 is a view showing a conventional water pump apparatus.
Figure 6:
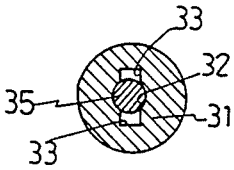
Fig 6 PRIOR ART
FIG. 6 is a view taken along line VI—VI in FIG. 5.

In the embodiment of FIG. 4, the thrust force is supported by use of a rotational shaft 25 provided with taper shaped flange portions 25*a*, 25*b* at a central portion thereof. The flange portions 25*a*, 25*b* have grooves corresponding to grooves 9 of the first embodiment. The shaft 25 is supported by a body member 21 and tapered bearing portions 27 fixed to the body member 21 and having passages corresponding to passages 12 and 13 of the first embodiment. The thrust force is supported by the flange portions 25*a*, 25*b* bearing on the bearing portions 27.

As above-mentioned, passage means are provided at upper and lower portions of the bearing portions for communicating left and right oil tanks with an intermediate oil tank formed between the bearing portions, so that the oil circulates between the left and right oil tanks and the intermediate oil tank. Further, the oil circulating grooves are provided on the inner circumferential surfaces of the bearing portions, so that the oil is smoothly delivered a sliding bearing surfaces between the rotational shaft and the bearing portions, which can be throughly lubricated. Any gas in the oil circulation flow path can outwardly escape via the check valve. Moreover, even if the pressure of the sealed oil within the oil tank is increased in accordance with a temperature increase, oil will not be leaked past the oil seals.

The flange portion extending perpendicular to the axle center is integrally formed at the central portion of the rotational shaft, so that the thrust force due to impeller rotation can be supported.

The taper shaped flange portion may instead be integrally formed at the central portion of the rotational shaft, so that the thrust force due to impeller rotation can be supported.

The interference of the impeller and housing due to position displacement as a result of thrust forces can thus be avoided.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed as new and desired to be secured by Letters Patent of the United States is:

1. A water pump apparatus, comprising:

a body member having mutually spaced bearing portions;

a driven rotational shaft rotatably supported in said body member by said bearing portions and having an impeller fixed thereon, whereby an axial thrust force is applied to said shaft;

oil seals surrounding said rotational shaft and spaced from said bearing portions so as to define in said body member a first oil tank between one of said seals and one of said body portions, a second oil tank between a second of said seals and a second of said body portions and a third oil tank between said spaced bearing portions;

thrust force support means on said shaft and having thrust bearing surfaces, oil passages extending through said bearing portions and communicating said third oil tank with each of said first and second oil tanks; and at least one spiral oil circulating groove extending between said third oil tank and each of said first and second oil tanks, each said oil circulating groove being formed on a sliding bearing surface between said rotational shaft and one of said bearing portions, each of said oil circulating grooves being oriented so as to pump oil therethrough and between said third oil tank and respective one of said first and second oil tanks in response to the rotation of said rotational shaft, wherein said sliding bearing surfaces and thrust bearing surfaces are lubricated and oil is circulated between said third oil tank and said first and second oil tanks.

2. The apparatus according to claim 1 wherein said thrust force supporting means comprise an annular flange on said rotational shaft and fitted between said bearing portions to help define said third oil tank, whereby axial thrust forces are supported by a thrust bearing surface of said flange bearing on one of said bearing portions.

3. The apparatus according to claim 2 wherein said thrust bearing surfaces of said flange extend transverse to an axis of said shaft.

4. The apparatus according to claim 3, wherein a flow path of circulating oil from aid oil circulating grooves to said oil passages passes between said thrust bearing surfaces and said one of said bearing portions in said third tank whereby said thrust bearing surfaces are lubricated.

5. The apparatus according to claim 2 wherein said flange is tapered.

6. The apparatus according to claim 2 wherein said sliding bearing surfaces having said oil circulating grooves comprise inner circumferential surfaces of said bearing portions.

7. The apparatus according to claim 1 including means for relieving pressure from said third tank to the exterior to said body member.

8. The apparatus according to claim 7 wherein said pressure relieving means is a check valve.

* * * * *